US008500610B2

(12) United States Patent
Bruce

(10) Patent No.: US 8,500,610 B2
(45) **Date of Patent: *Aug. 6, 2013**

(54) EXERCISE DEVICE

(75) Inventor: Gregory M. Bruce, Galveston, TX (US)

(73) Assignee: Season 4, LLC, Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/211,381

(22) Filed: Aug. 17, 2011

(65) Prior Publication Data

US 2011/0306478 A1 Dec. 15, 2011

Related U.S. Application Data

(63) Continuation of application No. 11/821,040, filed on Jun. 21, 2007, now Pat. No. 8,021,284, which is a continuation of application No. 10/441,717, filed on May 20, 2003, now Pat. No. 7,361,126.

(51) Int. Cl.
*A63B 21/00* (2006.01)

(52) U.S. Cl.
USPC ..... 482/112; 482/124; 482/126; 482/128

(58) Field of Classification Search
USPC ..... 482/121, 124, 126, 112, 77
See application file for complete search history.

(56) References Cited

U.S. PATENT DOCUMENTS 4,596,405 A * 6/1986 Jones ..... 280/823
5,759,139 A * 6/1998 Wright ..... 482/128

* cited by examiner

*Primary Examiner* — Jerome W Donnelly
(74) *Attorney, Agent, or Firm* — Tillman Wright, PLLC; Chad D. Tillman; Jeremy C. Doerre

(57) ABSTRACT

An exercise device for allowing a user to obtain a full body workout includes an innermost tubular member and an outermost tubular member, the tubular members fitted together and longitudinally and slidably movable in a telescoping manner relative to each other during the workout, a chamber within the outermost tubular member, the chamber receiving a compressible gas that provides resistance to relative movement of the tubular members, a collar between the innermost tubular member and the outermost tubular member, a lower limb connector attachment mounted to an end of one of the innermost or outermost tubular members for attachment to a lower limb of a user, and a gripping area at or near an opposite end of the other of the innermost and outermost tubular members to the lower limb connector attachment to stretch and strengthen the user's body muscles during the workout.

20 Claims, 5 Drawing Sheets

EXERCISE DEVICE

CROSS-REFERENCE TO RELATED APPLICATION

The present application is a U.S. continuation patent application of, and claims priority under 35 U.S.C. §120 to, U.S. nonprovisional patent application Ser. No. 11/821,040, filed Jun. 21, 2007, which '040 application published as U.S. patent application publication no. 2008/0045389, which '040 application and any patents or patent application publications thereof are hereby incorporated by reference herein, and which '040 application is a continuation of, and claims priority under 35 U.S.C. §120 to, U.S. nonprovisional patent application Ser. No. 10/441,717, filed May 20, 2003, which '717 application issued Apr. 22, 2008 as U.S. Pat. No. 7,361,126, which '717 application and any patents and patent application publications thereof are hereby incorporated by reference herein.

BACKGROUND OF THE INVENTION

1. Field of the Invention

The present invention relates to physical fitness and exercise. More specifically, the present invention provides an improved exercise device for enabling a user to obtain a full body workout.

2. Description of the Related Art

In recent years, the public has grown increasingly aware of the benefits of certain types of exercises in improving overall health and fitness. It has become popular to engage in exercises that provide a full body workout, where a person performs a set of coordinated movements aimed at utilizing different muscle groups throughout the body simultaneously. Full body workouts are thought to be more efficient and beneficial than those exercises that focus solely on one body part or group.

An example of a full body workout would be Tae Kwon Do, a form of martial arts in which a person performs movements that stretch and strengthen the muscles in the arms, legs, and upper and lower torso, including the back, buttocks, and abdomen, all at once. Using certain types of specialized equipment of the type available at certain gyms or health clubs and designed to provide resistance to movement can enhance the benefits to a person performing Tae Kwon Do or other full body workouts. However, many persons find it difficult to make time in their busy schedules to visit gyms or health clubs that have these types of specialized equipment.

As a result, there have been proposed in the prior art various small, portable exercise devices that are convenient for use at home or while away from home and traveling. For example, certain patents disclosed tubular exercise devices that utilized pressurized air to create resistance to a user's movement. These types of devices had handgrips or handles at each end, so that a user could develop or tone the muscles of the arms and upper torso. These devices were not, as far as is known, adapted or suitable for developing or exercising muscles in the buttocks, legs, or other parts of the body other than the arms and upper torso. These devices also were not suitable for use in exercises to obtain the benefits of full body training and strengthening similar to those obtained through Tae Kwon Do or other forms of martial arts training.

Certain other patents disclosed tubular exercise devices that utilized oil, springs, or resilient bonds instead of pressurized air to provide resistance to movement. These additional elements were problematic in that they were subject to fluid leaking or breakage. Again, these devices were not, as far as is known, adapted or suitable for allowing a user to exercise a variety of muscle groups all at once by simulating the movements made during Tae Kwon Do or other forms of martial arts training. Other patents allowed a user to simulate the movements made during specific outdoor sports, such as cross-country skiing. These devices, while useful for obtaining a full body workout, were cumbersome and not designed to be portable.

SUMMARY OF THE INVENTION

The present invention relates to an improved exercise device for enabling a user to obtain a full body workout. A tubular exercise device is provided that has two or more pieces of tubing material fitted together in a telescoping manner. The device has a handgrip at one end and a strap of some resilient or elastic material at the other end that allows a user to securely place a foot for exercise purposes. The device utilizes pressurized air to create resistance to movement for a user, thereby allowing a user to exercise a variety of muscle groups all at once by simulating the movements made during Tae Kwon Do or other forms of martial arts training.

The present invention may also include as additional features one or more of the following: a stretchable resistance band connected to the exercise device that expands to provide resistance to a user upon telescoping withdrawing movement of the innermost tubular member from the outermost tubular member; a counting mechanism on the device to tally the number of telescoping inward and outward movements of the tubular members; and a stretchable connecting band for connecting two of the exercise devices together and providing resistance when performing exercises where the devices are pulled apart from one another.

BRIEF DESCRIPTION OF THE DRAWINGS

A better understanding of the present invention can be obtained when the detailed description set forth below is reviewed in conjunction with the accompanying drawings, in which.

DETAILED DESCRIPTION OF THE PREFERRED EMBODIMENTS

Figure 1:
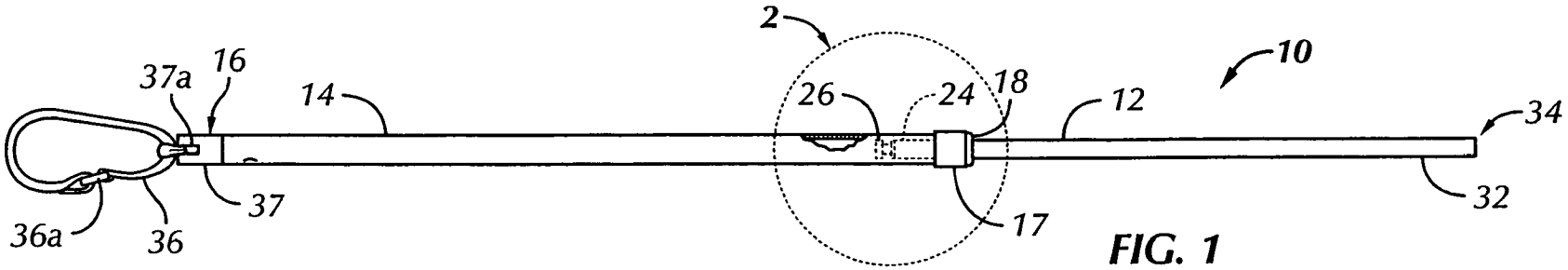
FIG. 1 is a side view, taken partly in cross-section, of the preferred embodiment of the present invention.

As illustrated in FIG. 1, an exercise device 10 according to the present invention is composed in the embodiment illustrated of at least two tubular members, including an inner tube 12 and an outer tube 14. The tubular members are constructed of a material of suitable strength, for example plastic, metal, synthetic resin, or suitable composite fiber. Outer tube 14 has an outer end 16, an open inner end 18, and a hollow interior chamber 20 extending within interior of the tubing. Inner tube 12 has an outer end 22, an inner end 24, and is of an outer smaller than the inner diameter of outer tube 14. Thus the inner end 24 of inner tube 12 is fitted into, and can be moved within, outer tube 14 in a telescoping manner.

A collar 17 is provided on the tube 14 at its outer end 16 to receive the tube 12. The collar 17 allows sliding movement of the tube 12 within the interior of tube 14. A raised limit stop rim or shoulder 12*a* is provided to retain the collar 17 on the tube 12. The collar 17 serves several purposes. The collar 17 serves to receive and restrain the end 22 of tube 12 from easily pulling apart from tube 14. The collar 17 also serves as an insertion guide when tubes 12 and 14 are being fitted together. Further, the inner diameter of collar 17 and relative clearance between collar 17 and inner tube 12 govern the amount of air pressure or relative vacuum in the interior chamber 20. The collar 17 by governing the amount of air pressure and relative vacuum governs the amount of resistance exerted in telescoping movement of the device.

The collar 17 may also be made in adjustable form to adjust the amount of air pressure and relative vacuum to vary the amount of such resistance. For example, the collar 17 may be in the form of a first threaded male part mounted on top of the outer tube 14, with a second part threadedly attached thereto. The inner tube 12 loosely fits within the collar 17. A washer of resilient material such as rubber is mounted between the two threadedly connected parts of the collar 17. The two threaded parts of the collar when moved together expand the washer inwardly, restricting the amount of air flow between tubes 12 and 14, and also affording resistance to telescoping movement of the tubes 12 and 14 once frictional contact is achieved between the washer and inner tube 12.

The length of hollow chamber 20 within tube 14 is defined on one end by closed or sealed outer end 16 of outer tube 14 and on the other end by the inner end 24 of inner tube 12. Thus, the length of hollow chamber 20 changes as a user moves inner tube 12 telescopically within outer tube 14 during exercise. Hollow chamber 20 holds compressible air that provides resistance to the movement of a user during exercise. The air is drawn in from the surrounding atmosphere during use of the device 10.

Figure 2:
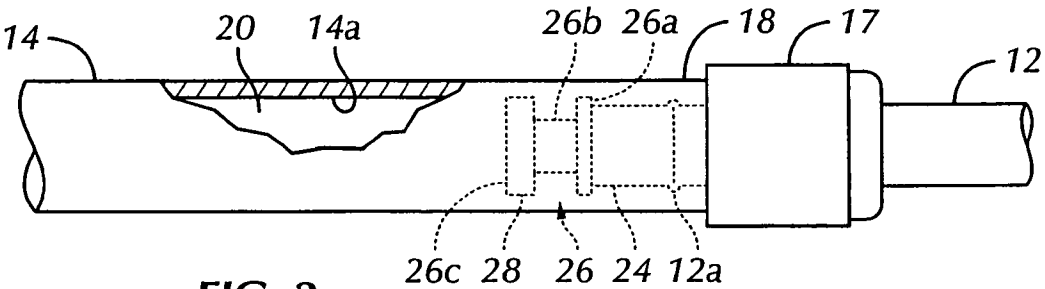
FIG. 2 is an enlarged view of that portion of FIG. 1 encircled and having reference numeral "2" indicate same.

As shown in FIG. 2, the concealed inner end 24 of inner tube 12 is a hollow tubular opening provided with an end cap 26. The cap 26 is a generally spool-shaped structure having an inner rim or shoulder 26*a* adjacent the opening 24 of tube 12, a central shaft 26*b* and an outer rim or shoulder 26*c*. The end cap 26 may be attached to the tube 12 by any suitable conventional technique. In one embodiment, the cap 26 has an inward portion (not shown) extending from inner rim 26*a* and fitted into the end 24. The tube 12 is then fitted onto the inward portion. The end cap 26 and its inner rim 26*a* thus serve to close the inner tube 12 at its concealed inner end 24. If desired, the central shaft 26*b* can be eccentrically located so that the tubes 12 and 14 can be locked together at a particular extended length by relative rotational movement between them. The end cap 26 is further provided with a gasket or ring 28 mounted around the circumferential extent of outer rim 26*c* to allow reciprocal sliding movement of the inner end 24 of inner tube 12 within the interior 20 of tube 14 adjacent an inner wall 14*a*.

The gasket or ring 28 of cap 26 does not, however, provide a hermetic or airtight seal against escape of air from within interior 20 of tube 14 into the atmosphere. Rather, small amounts of such air are allowed to pass by the ring 28 but at a rate that is less than the volume or amount of compression by the inner tube 12 during its movement inwardly into the outer tube 14. In this manner, a resistive force is exerted on the air within interior 20 of outer tube 14 as it is being compressed by inward movement of the tube 12.

After the completion of an inward stroke of the tube 12 into the tube 14, a replacement volume of air is drawn past collar 17 into the interior 20 of tube 14 as a user expands or elongates device 10 by pulling inner tube 12 telescopically outwardly from outer tube 14. The air is drawn into hollow chamber 20 past the gasket or seal 28 on cap 26. The indrawn air fills the volume of hollow chamber 20 as the volume of the chamber expands while tube 12 moves outwardly. Cap 26 blocks open inner end 18 of outer tube 14 to prevent the drawn-in air from escaping hollow chamber 20 into the interior of tube 12. On the next compression cycle, as a user contracts device 10 by pushing inner tube 12 telescopically into outer tube 14, the air contained in hollow chamber 20 is compressed and only small portions escape from chamber 20, thus providing resistance from device 10 to muscle movement by a user.

Figure 3:
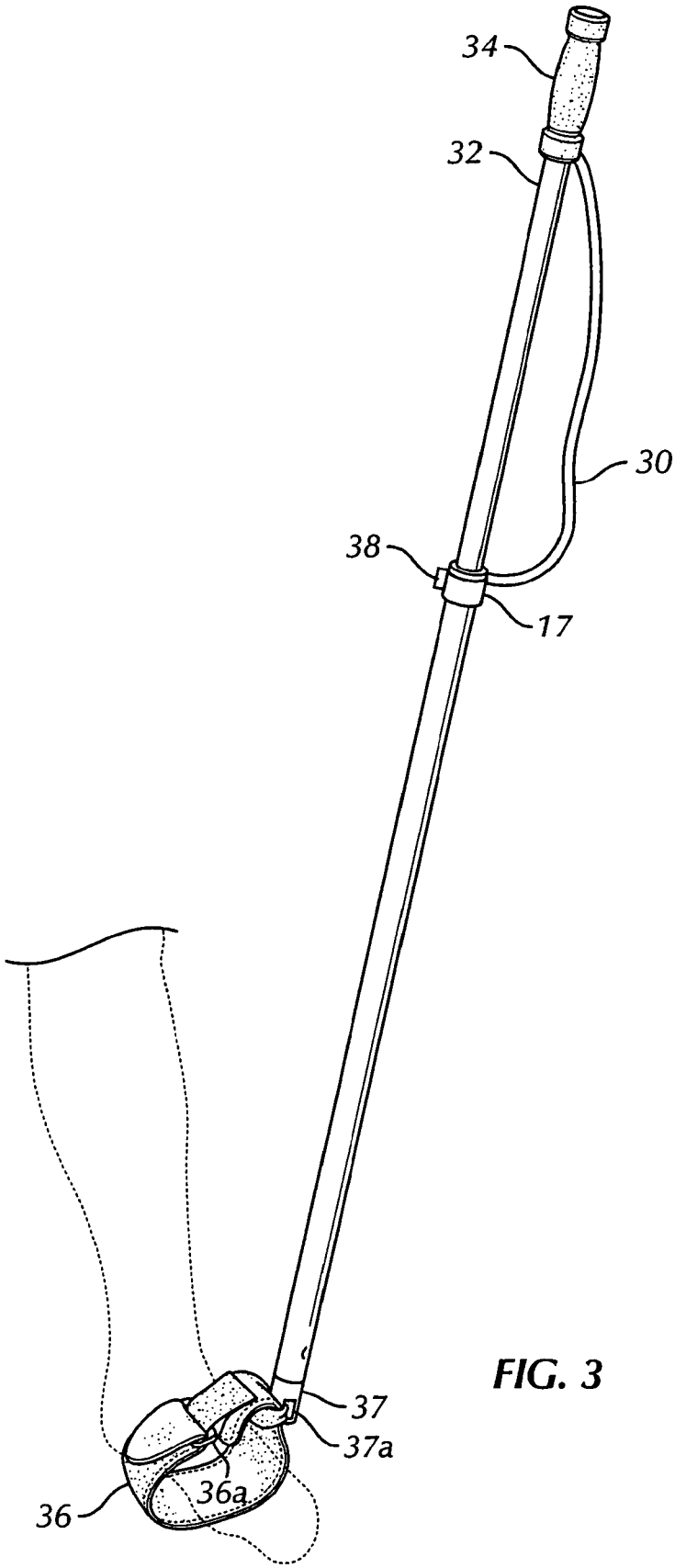
FIG. 3 is a side view of another embodiment of the present invention.

As illustrated in FIG. 3, a stretchable resistance band 30 can be attached to exercise device 10 to provide additional resistance to a user during expansion movement. Resistance band 30 is stretched as a user slides inner tube 12 telescopically out from within outer tube 14. Resistance band 30 then contracts as a user slides inner tube 12 telescopically into outer tube 14. In FIG. 3, stretchable band 30 is shown connected to the outside of device 10; however, stretchable band 30 can also be located in hollow chamber 20 inside of outer tubing 14, so that it does not interfere with user during exercising.

There is a gripping area 32 on at least one of outer ends 16, 22 of the tubing material for a user to grasp with his or her hand while using device 10. FIG. 1 shows gripping area 32 on inner tube 12, but it can be located on either inner tube 12 or outer tube 14. Gripping area 32 can consist of the bare outer surface of the tubing. If desired, the tubing surface in the location of gripping area 32 could be modified or adapted to provide a better gripping surface for a user. For example, knurls (not shown) or crenellations (not shown) could be added to an exterior area of the bare surface of the tubing adequate for grip by a user's hand. As illustrated in FIG. 3, a grip member 34, such as a cap, cover, sleeve, or other outer covering can also be provided at gripping area 32 to protectively cover the tubing material and to facilitate more comfortable gripping of the exercise device 10 by a user.

A lower limb connector attachment in the form of a connecting strap 36 is provided on the exercise device 10 at an opposite end from the gripping area 32. Thus, the opposite one of outer ends 16, 22 of the tubular member from gripping area 32, as shown on outer end 16 in FIG. 1, has the connecting strap 36 mounted with it. The strap 36 may be a unitary band, or a closable loop as shown closed by a buckle 36*a* or other suitable connector or closure structure. Connecting strap 36 is made of a flexible material of suitable strength that allows for firm but gripping attachment to a limb of a user, preferably a lower limb such as the leg, ankle or foot. The flexible material of the strap 36 may be resilient, or elastic, if desired.

It should be understood that the lower limb connector attachment of the preferred embodiment may take the form of various modifications or supplements to the strap 36. For example, the strap 36 may be modified by addition of material to take the form of a boot, shoe, or other form of foot covering. The strap 36 alternatively may be replaced by such a detachable boot, shoe or other foot covering. It is preferable, however, that the connector attachment maintain firm but gripping attachment to the lower limb of the user.

The connecting strap 36 of the connector attachment is typically about one or two inches in width and may be attached to the device 10 by any number of alternative arrangements. For example, the connecting strap 36 may be mounted directly or by a connector (as shown in FIG. 1) extending through an eyelet or port 37*a* of a socket or cap 37 fitted over the end 16 of tube 14. The cap 37 serves to close or seal end 16 of tube 14. Alternatively, the connecting strap 36 may be formed as an integral part of the cap 37, or the strap 36 may be glued to cap 37 or attached by snaps, Velcro straps or a number of other suitable forms of connectors.

FIG. 3 shows connecting strap 36 attached to a foot (shown schematically in phantom at F) of a user. Strap 36 allows for cushioned migration across the foot as a user moves device 10 in various directions while exercising. Connecting strap 36 can be wrapped around a limb and fastened with Velcro, or else it could have a noose that can be tightened and adjusted to provide a secure attachment, so that strap 36 does not slip off of a user's limb during exercise. The fit of strap 36 should be secure, but not so rigid or tight as to possibly cause pain or injury to a user. It is to be noted that the strap 36 permits users to affix the device to their body at a selected portion of a limb, either an arm or leg, depending on the selected full body workout. The resilience or elasticity of the strap 36 causes the device 10 to remain engaged with the user's limb. Thus the device 10 is not as likely to slip or become disengaged, as would be the case if an exercise of earlier types with handgrips at each end were used.

If desired, a conventional counting mechanism 38 could be attached such as on collar 17 to exercise device 10 to sense relative movement of the two tubular members 12 and 14 and count or tally the number of repetitions of telescopic movement of inner tube 12 and outer tube 14. Counting mechanism 38 could also be used to provide a signal or other indication at the end of a preselected number of repetitions.

Figure 4:
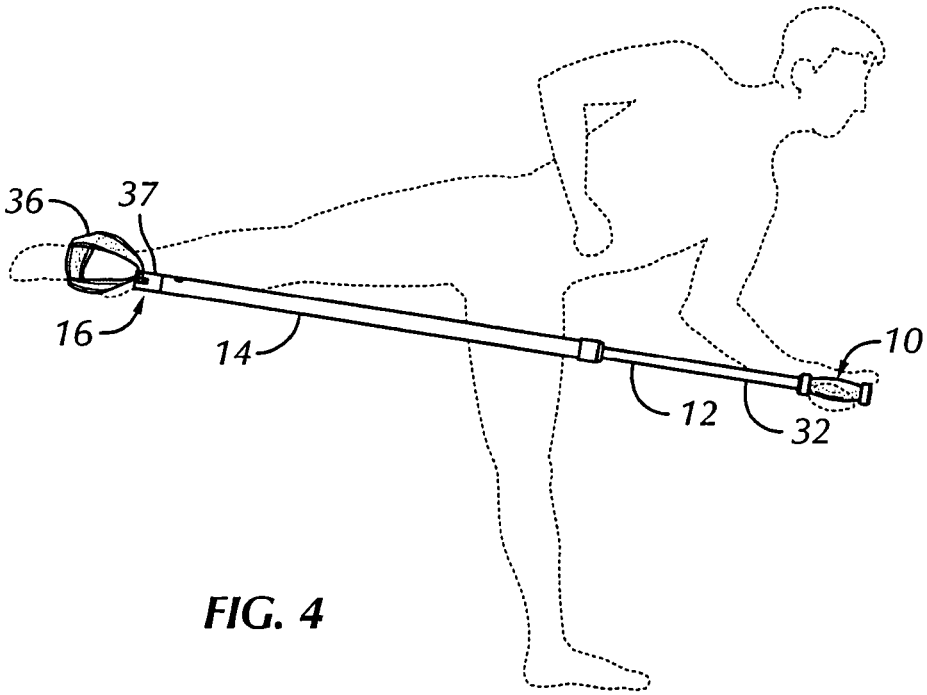
FIGS. 4, 5 and 6 are isometric views, partially schematic, of the apparatus of the present invention being used for various forms of full body workout.
Figure 5:
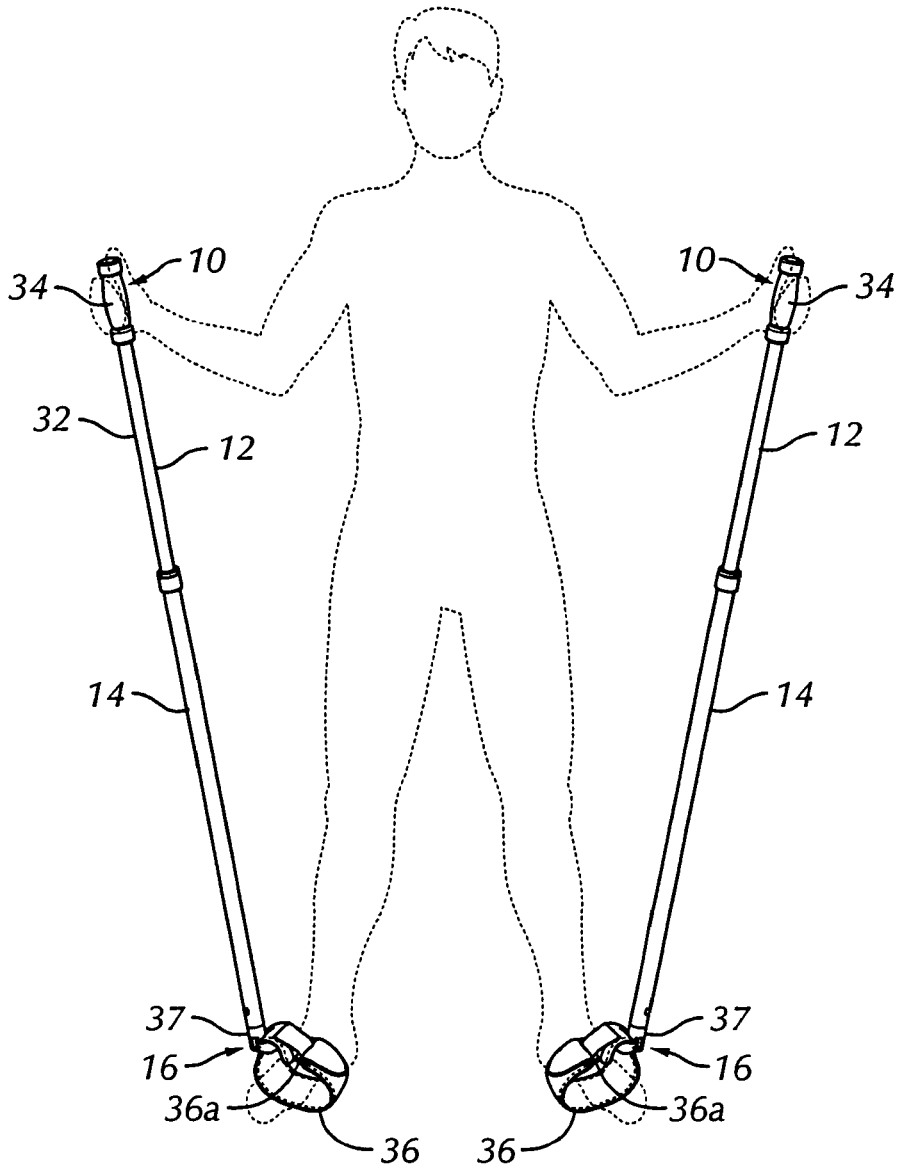
Figure 6:
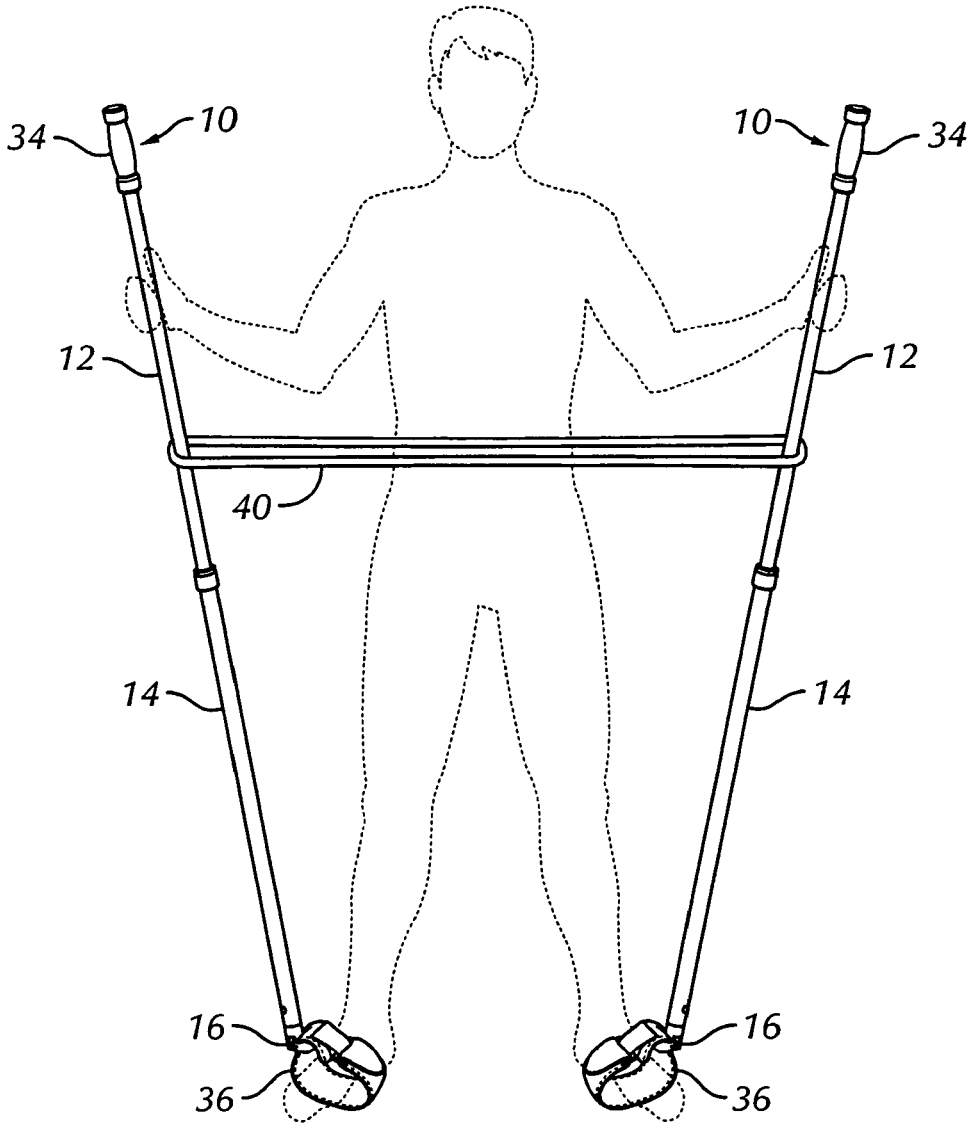

FIGS. 4, 5 and 6 show a user performing a variety of full body workout exercises with device 10. By grasping gripping area 32 with a hand and securing connecting strap 36 to a foot, users can expand and contract the device 10 by moving the tubes 12 and 14 in and out with respect to each other in while moving their body in a variety of directions. Further, the flexible material of strap 36 allows the strap to yield and conform to the shape of the point of attachment or connection to the user's body, whether the foot or other body portion of the user. Thus, as the user moves to various body positions (FIGS. 4, 5, and 6) during a full body workout with the device 10 of the present invention, the resistive forces of the device are maintained and applied to the user's body muscles. Exercises can be performed using one device 10, as shown in FIG. 4, or with multiple devices 10, as shown in FIG. 5. FIG. 6 shows a stretchable connecting band 40 attached between two of the devices 10, to provide resistance when a user pulls the devices 10 apart from one another.

It can thus be seen that the exercise device 10 permits a user to perform a full body workout according to the present invention. The user may perform movements, working against resistive forces offered by the device 10 to stretch and strengthen muscles in the arms, legs and upper and lower torso at the same time. By connection the device at the user's hand with handgrip area 32 and to the user's foot or leg at the connecting strap 36, various particular portions of the user's musculature may be selectively chosen and subjected to exercise for a selected number of repetitions or for a chosen length of time.

It should be noted and understood that there can be improvements and modifications made of the present invention described in detail above without departing from the spirit or scope of the invention as set forth in the accompanying claims.

What is claimed is:

1. An exercise device for allowing a user to obtain a full body workout, comprising:

an innermost tubular member and an outermost tubular member, the tubular members being configured to be fitted together such that the tubular members are longitudinally and slidably movable in a telescoping manner relative to each other during the workout;

a chamber within the outermost tubular member configured to receive a compressible gas that provides resistance to relative movement of the tubular members when the tubular members are fitted together;

a collar provided at an end of the outermost tubular member, the collar being configured to allow gas in the chamber, the collar further having an inner diameter configured to receive the innermost tubular member in a manner which allows relative longitudinal sliding telescoping movement between the innermost tubular member and the outermost tubular member by the user during the workout, clearance between the collar and the innermost tubular member, when the innermost tubular member is received within the collar, governing pressure in the chamber and the amount of resistance to relative movement between the innermost and outermost tubular members;

a lower limb connector attachment mounted to an end of one of the innermost or outermost tubular members for attachment to a lower limb of a user; and a gripping area at or near an opposite end of the other of the innermost and outermost tubular members to the lower limb connector attachment for allowing a user to, when the tubular members are fitted together, grasp the gripping area of the device and cause relative longitudinal sliding telescoping movement of the tubular members between the connector attachment and the gripping area to stretch and strengthen the user's body muscles during the workout.

2. The exercise device of claim 1, wherein the collar comprises an adjustable collar.

3. The exercise device of claim 2, wherein the adjustable collar is configured to adjust the amount of resistance to relative movement between the innermost and outermost tubular members when the tubular members are fitted together.

4. The exercise device of claim 1, further including a connecting band configured to connect two or more devices together to provide resistance to relative movement of the devices.

5. The exercise device of claim 1, wherein the gripping area comprises a handle.

6. The exercise device of claim 1, wherein the gripping area includes a knurled surface formed thereon.

7. The exercise device of claim 1, wherein the gripping area includes crenellations formed thereon.

8. The exercise device of claim 1, wherein the lower limb connector is a detachable foot covering.

9. The exercise device of claim 1, wherein the lower limb connector attachment comprises a strap.

10. The exercise device of claim 1, wherein the lower limb connector attachment includes a strap with a closable loop.

11. An exercise device for allowing a user to obtain a full body workout, comprising:

an innermost tubular member and an outermost tubular member, the tubular members being configured to be fitted together such that the tubular members are longitudinally and slidably movable in a telescoping manner relative to each other during the workout;

a chamber within the outermost tubular member, the chamber being configured to, when the tubular members are fitted together, contain a compressible gas that provides resistance to relative movement of the tubular members;

a collar provided at an end of the outermost tubular member that includes an inner opening having a diameter sized to receive the innermost tubular member, the collar being configured such that, when the innermost tubular member is received within the collar, the collar allows relative longitudinal sliding telescoping movement of the innermost tubular member relative to the outermost tubular member, and clearance between the collar and the innermost tubular member allows gas to pass into or out of the chamber, the amount of clearance at least partially governing a pressure level in the chamber and an amount of resistance to longitudinal sliding telescoping movement of the innermost tubular relative to the outermost tubular member;

a connector attachment mounted to an end of one of the innermost or outermost tubular members configured for attachment to a body part of a user; and a gripping area at or near an opposite end of the other of the innermost and outermost tubular members to the connector attachment for allowing a user to, when the tubular members are fitted together, grasp the gripping area of the device and cause relative longitudinal sliding telescoping movement of the tubular members to stretch and strengthen the user's body muscles during the workout.

12. The exercise device of claim 11, wherein the collar comprises an adjustable collar.

13. The exercise device of claim 12, wherein the adjustable collar is configured to adjust the amount of resistance to relative movement between the innermost and outermost tubular members when the tubular members are fitted together.

14. The exercise device of claim 11, further including a connecting band configured to connect two or more devices together to provide resistance to relative movement of the devices.

15. The exercise device of claim 11, wherein the gripping area comprises a handle.

16. The exercise device of claim 11, wherein the gripping area includes a knurled surface formed thereon.

17. The exercise device of claim 11, wherein the gripping area includes crenellations formed thereon.

18. The exercise device of claim 11, wherein the connector attachment is a detachable foot covering.

19. The exercise device of claim 11, wherein the connector attachment comprises a strap.

20. The exercise device of claim 11, wherein the connector attachment includes a strap with a closable loop.

* * * * *